US008958740B2

(12) United States Patent
Watanabe et al.

(10) Patent No.: US 8,958,740 B2
(45) Date of Patent: Feb. 17, 2015

(54) CONFIGURATION FOR A SHEET DISCHARGING DEVICE

(75) Inventors: Yasunori Watanabe, Nagoya (JP); Tatsuya Koyama, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 198 days.

(21) Appl. No.: 13/407,045

(22) Filed: Feb. 28, 2012

(65) Prior Publication Data

US 2012/0219338 A1 Aug. 30, 2012

(30) Foreign Application Priority Data

Feb. 28, 2011 (JP) ..... 2011-042080
Mar. 10, 2011 (JP) ..... 2011-053156

(51) Int. Cl.
*G03G 15/00* (2006.01)
*B65H 29/52* (2006.01)

(52) U.S. Cl.
CPC ..... *G03G 15/6552* (2013.01); *B65H 29/52* (2013.01); *B65H 2404/63* (2013.01)
USPC ..... 399/405; 271/209; 271/188

(58) Field of Classification Search
USPC ..... 399/405, 407, 397, 367, 369; 271/161, 271/188, 209, 73, 279
See application file for complete search history.

(56) References Cited

U.S. PATENT DOCUMENTS 6,412,774 B1 7/2002 Saito et al.
2007/0177916 A1* 8/2007 Ninomiya ..... 399/405
2009/0214279 A1 8/2009 Ito
2010/0254740 A1* 10/2010 Murata ..... 399/401

FOREIGN PATENT DOCUMENTS

| | | | |
|---|---|---|---|
| JP | 54-008503 | | 1/1979 |
| JP | 3-192065 | A | 8/1991 |
| JP | 3-265481 | A | 11/1991 |
| JP | 05-040252 | | 5/1993 |
| JP | 6-121592 | A | 4/1994 |
| JP | 6-197576 | A | 7/1994 |
| JP | 08-217293 | | 8/1996 |
| JP | 2000338799 | A | 12/2000 |
| JP | 2001116131 | A | 4/2001 |
| JP | 2001302068 | A | 10/2001 |

(Continued)

OTHER PUBLICATIONS

Notice of Reasons for Rejection received in corresponding Japanese Patent Application No. 2011-042080, mailed Feb. 26, 2013.

(Continued)

*Primary Examiner* — Matthew G Marini
(74) *Attorney, Agent, or Firm* — Banner & Witcoff, Ltd.

(57) ABSTRACT

An apparatus configured to discharge sheets may include pressing mechanism configured to downwardly press discharged sheets. For example, the pressing mechanism may include a first pressing member and a second pressing member. The first pressing member and the second pressing member may be located at least partially overlapping positions in the width-wise direction of the sheet. Additionally or alternatively, each of the first pressing member and the second pressing member may be configured to contact the sheet at different positions along a discharge direction. In one example, the different portions may be spaced apart from each other in the discharge direction.

9 Claims, 10 Drawing Sheets

(56) References Cited

FOREIGN PATENT DOCUMENTS

| | | | |
|---|---|---|---|
| JP | 2002104709 | A | 4/2002 |
| JP | 2002211814 | A | 7/2002 |
| JP | 2002-293470 | A | 10/2002 |
| JP | 2003081515 | A | 3/2003 |
| JP | 2004199780 | A | 7/2004 |
| JP | 2004-307157 | A | 11/2004 |
| JP | 2005-001893 | A | 1/2005 |
| JP | 2005096964 | A | 4/2005 |
| JP | 2006103095 | A | 4/2006 |
| JP | 2008063080 | A | 3/2008 |
| JP | 2008120494 | A | 5/2008 |
| JP | 2008197252 | A | 8/2008 |
| JP | 2009202965 | A | 9/2009 |

OTHER PUBLICATIONS

Notice of Reasons for Rejection received in corresponding Japanese Patent Application No. 2011-053156, mailed Mar. 12, 2013.

* cited by examiner

CONFIGURATION FOR A SHEET DISCHARGING DEVICE

CROSS REFERENCE TO RELATED APPLICATION

This application claims priority from Japanese Patent Application No. 2011-042080, filed on Feb. 28, 2011, and Japanese Patent Application No. 2011-053156, filed on Mar. 10, 2011. The entire subject matter of the above referenced applications is incorporated herein by reference.

TECHNICAL FIELD

Aspects described herein relate to an image forming apparatus.

BACKGROUND

Current technologies have proposed an image forming apparatus that presses a sheet from above using a sheet holder when an image is formed on the sheet (e.g., a recording sheet) and that discharges the sheet to a discharge tray. For example, the above noted sheet holder may be provided near a discharge roller so as to be able to pivot about its upper end, and to press a sheet from above due to its weight.

When a sheet holder is provided and a sheet is separated from the discharge roller, a rear edge, in a transfer direction (hereinafter, referred to merely as rear edge), of the sheet can be forced to shift downwardly by the sheet holder.

BRIEF SUMMARY

However, even if a sheet holder as described above is provided, when a rigid sheet is curled width-wise, and when the sheet holder is too light, a portion cambered with the curling may not be sufficiently shifted downwardly. Thus, in such cases, the sheet holder might not function effectively. For example, the front edge of a sheet that is subsequently discharged is likely to collide against the rear edge of a previously discharged sheet. Thus, improper loading or discharging of recording media may occur.

Meanwhile, even in the case where a rigid sheet is significantly curled, if the weight of the sheet holder is sufficiently high, a portion cambered with the curling can be shifted downwardly.

However, when a limp sheet is discharged, even if the sheet comes into contact with the sheet holder, the sheet holder is not moved upward. Thus, discharging of the sheet may be disturbed by the sheet holder, thereby causing damage to the sheet For example, with the contact with the sheet holder, the sheet may buckle, thereby causing a wrinkle.

Accordingly, the above-described existing sheet holder may cause problems depending on the rigidity of a sheet, even when the weight of the sheet holder is decreased or increased.

Aspects described herein provide a sheet discharging device which allows a sheet to be discharged and loaded without damage or other problems, regardless of the rigidity of the sheet. For example, the sheet discharging device may include pressing members configured to provide a pressing force on a sheet to discharge the sheet without damaging the sheet and/or while maintaining appropriate loading.

DETAILED DESCRIPTION

Next, example embodiments will be described.

First Embodiment

Structure of Image Forming Apparatus

Figure 1:
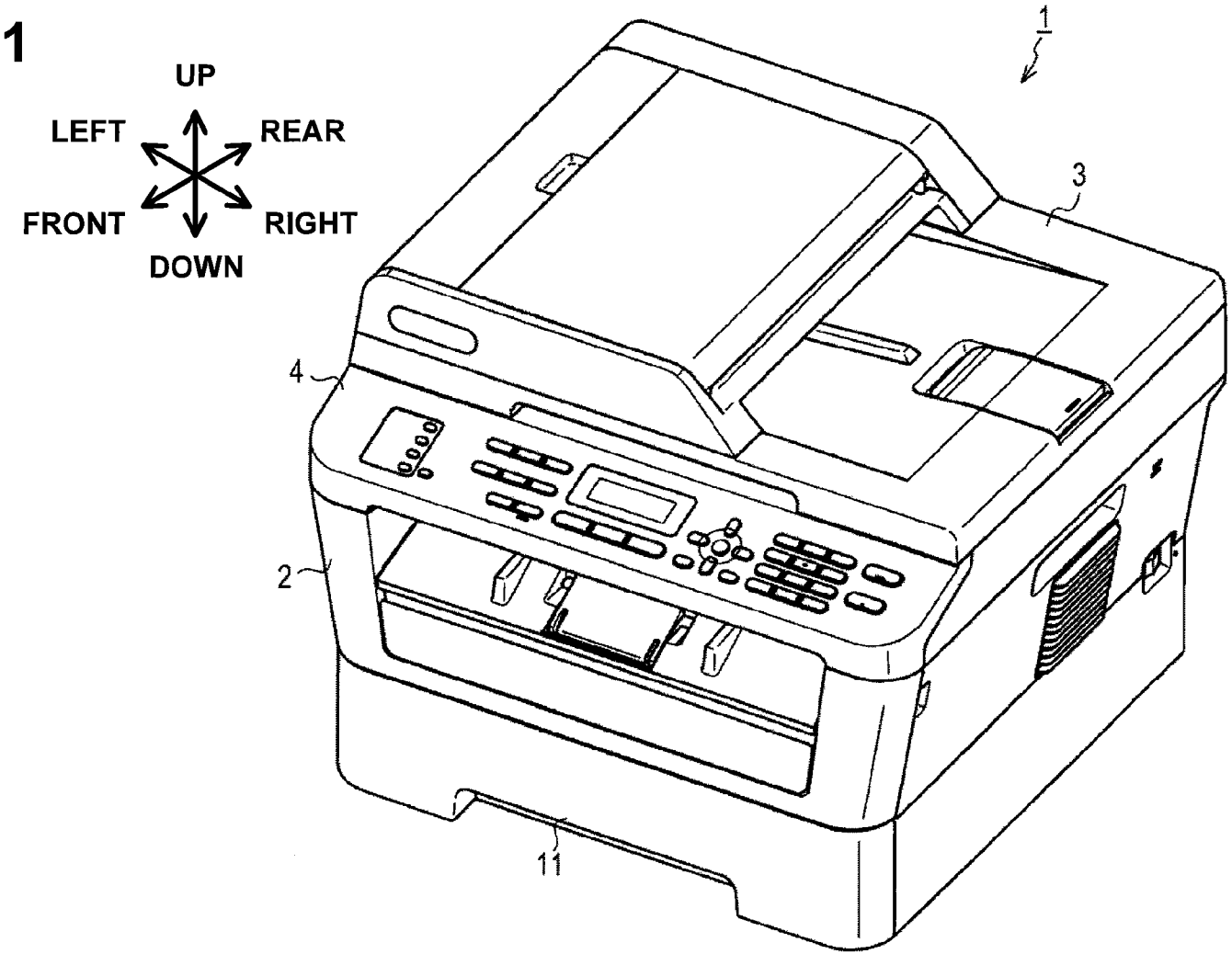
FIG. 1 is a perspective view of an example image forming apparatus according to a first embodiment.

A multi function device 1 shown in FIG. 1 includes functions such as an image forming apparatus and/or other functions (e.g., an image reading device, a communication device, and the like). In the following description, directions of up, down, right, left, front, and rear correspond to the directions indicated in the drawings.

The multi function device 1 includes a printer section 2, a scanner section 3 mounted on the top of the printer section 2, and an operation section 4 disposed on the top of the printer section 2 and in front of the scanner section 3. The scanner section 3 has a structure in which an ADF (Automatic Document Feeder) is mounted to an upper cover of a flat-bed image scanner.

Figure 2:
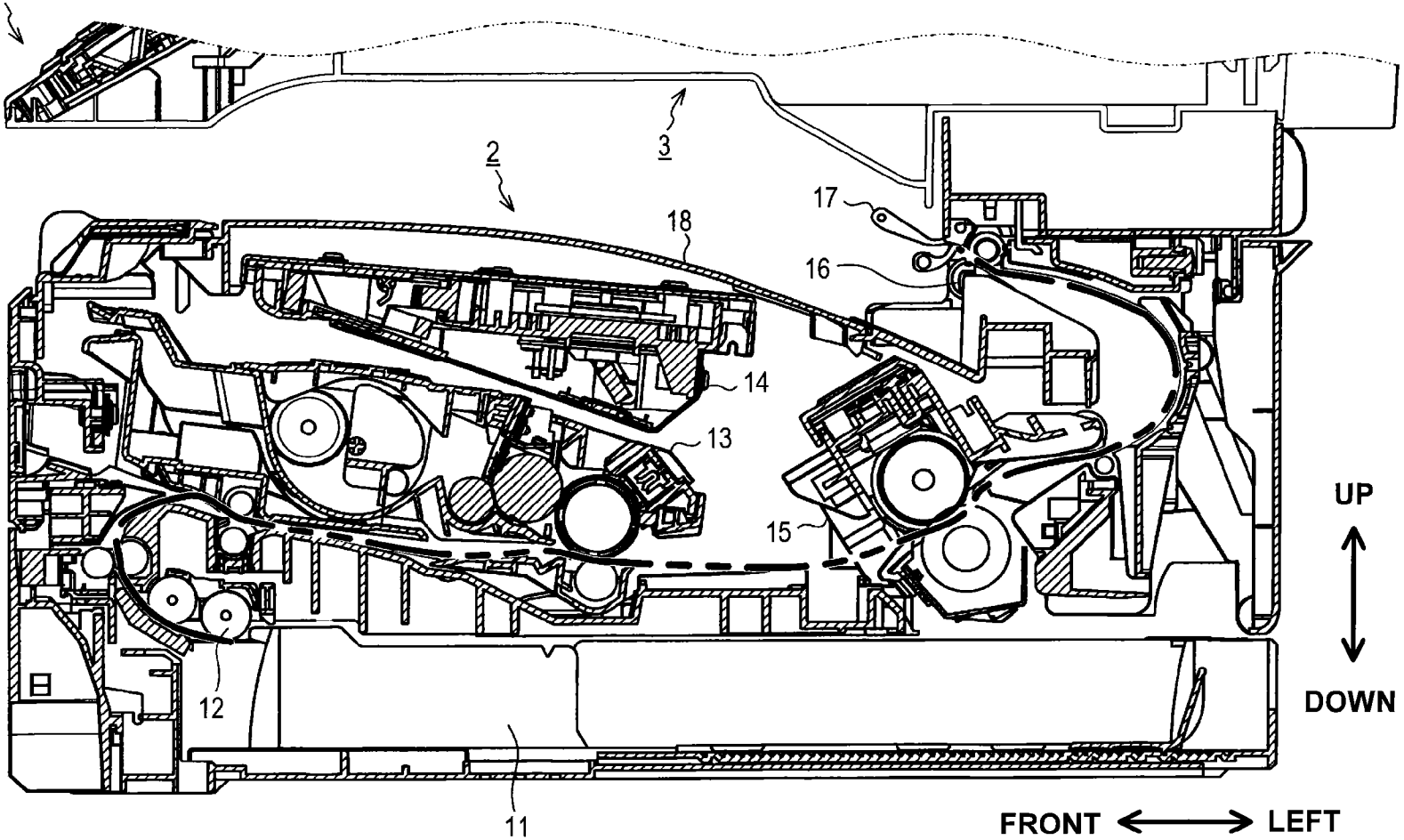
FIG. 2 is a longitudinal cross-sectional view illustrating an example image forming mechanism of the image forming apparatus according to the first embodiment.

As shown in FIG. 2, the printer section 2 includes a feeding cassette 11, a feeding mechanism 12, a process cartridge 13, a laser scanner 14, a fuser 15, a discharging mechanism 16, and a pressing mechanism 17.

The feeding cassette 11 is a portion which accommodates recording media therein, and is configured to be drawn toward the front side of the multi function device 1 and to be attachable and detachable to and from the multi function device 1. The feeding mechanism 12 is a mechanism configured to transfer the recording media accommodated in the feeding cassette 11, to below the process cartridge 13. The feeding mechanism 12 includes a group of rollers configured to rotate in contact with a sheet or rotate while holding a sheet therebetween, and a guide portion configured to guide the sheet transferred by the group of rollers, in a predetermined transfer direction. Further, a power transmission mechanism (e.g., a gear mechanism, a cam mechanism, and the like) is also provided and configured to transmit power from a power source (e.g., a motor etc.), which is not shown, to the group of rollers of the feeding mechanism 12.

The process cartridge 13 includes a photoconductor and a developing mechanism configured to develop an electrostatic latent image formed on the photoconductor. The laser scanner 14 is a device configured to irradiate the photoconductor of the process cartridge 13 with a laser beam to form an electrostatic latent image on the photoconductor. The fuser 15 is a device configured to hold a sheet on which a toner image is transferred by the process cartridge 13, between a pair of rollers and to heat and pressurize the sheet to fix the toner image on the sheet.

The discharging mechanism 16 is a mechanism configured to transfer a sheet sent out from the fuser 15, to a discharge tray 18 formed at the top of the printer section 2. The discharging mechanism 16 includes a group of rollers configured to rotate in contact with a sheet or to rotate while holding a sheet therebetween, and a guide portion configured to guide the sheet transferred by the group of rollers, in a predetermined transfer direction. Further, a power transmission mechanism (e.g., a gear mechanism, a cam mechanism, and the like) is also provided and is configured to transmit power from a power source (e.g., a motor etc.), which is not shown, to the group of rollers of the discharging mechanism 16.

[Structure of Pressing Mechanism]

Figure 3:
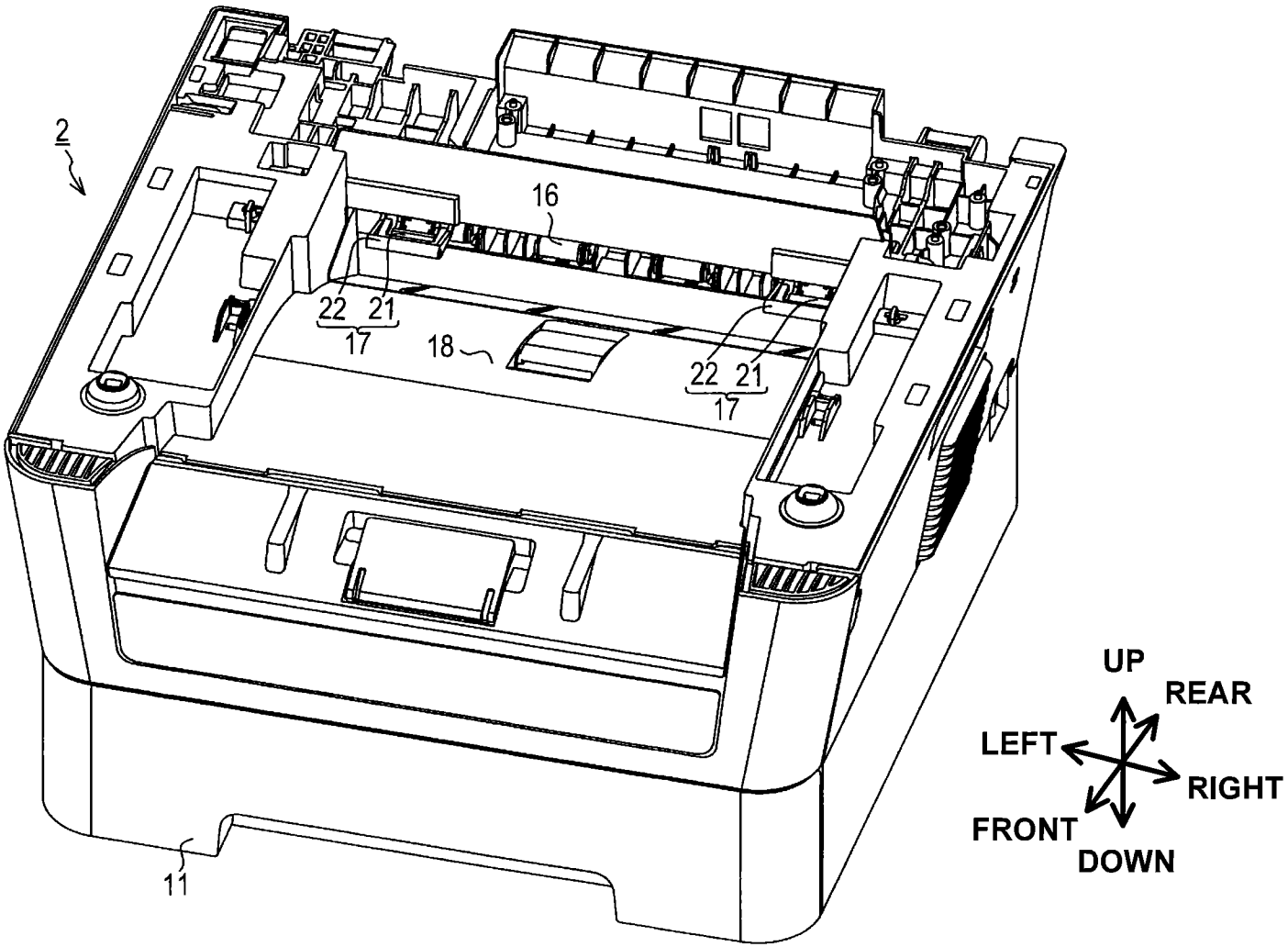
FIG. 3 is a perspective view showing the image forming mechanism obliquely from above, wherein an image reading mechanism is removed from the image forming apparatus according to the first embodiment.

The pressing mechanism 17 is a pressing means configured to downwardly press a sheet discharged by the discharging mechanism 16 onto the discharge tray 18, and includes a first pressing member 21 and a second pressing member 22. Two pairs of pressing members may be provided, where each pair includes a first pressing member 21 and a second pressing member 22. In one example, a first pair of pressing members may be provided at a position spaced apart from a second pair of pressing members in the width-wise direction of the sheet (e.g., in the right-left direction shown in FIG. 3) as shown in FIG. 3. Accordingly, both edges of the sheet can be pressed.

Figure 4:
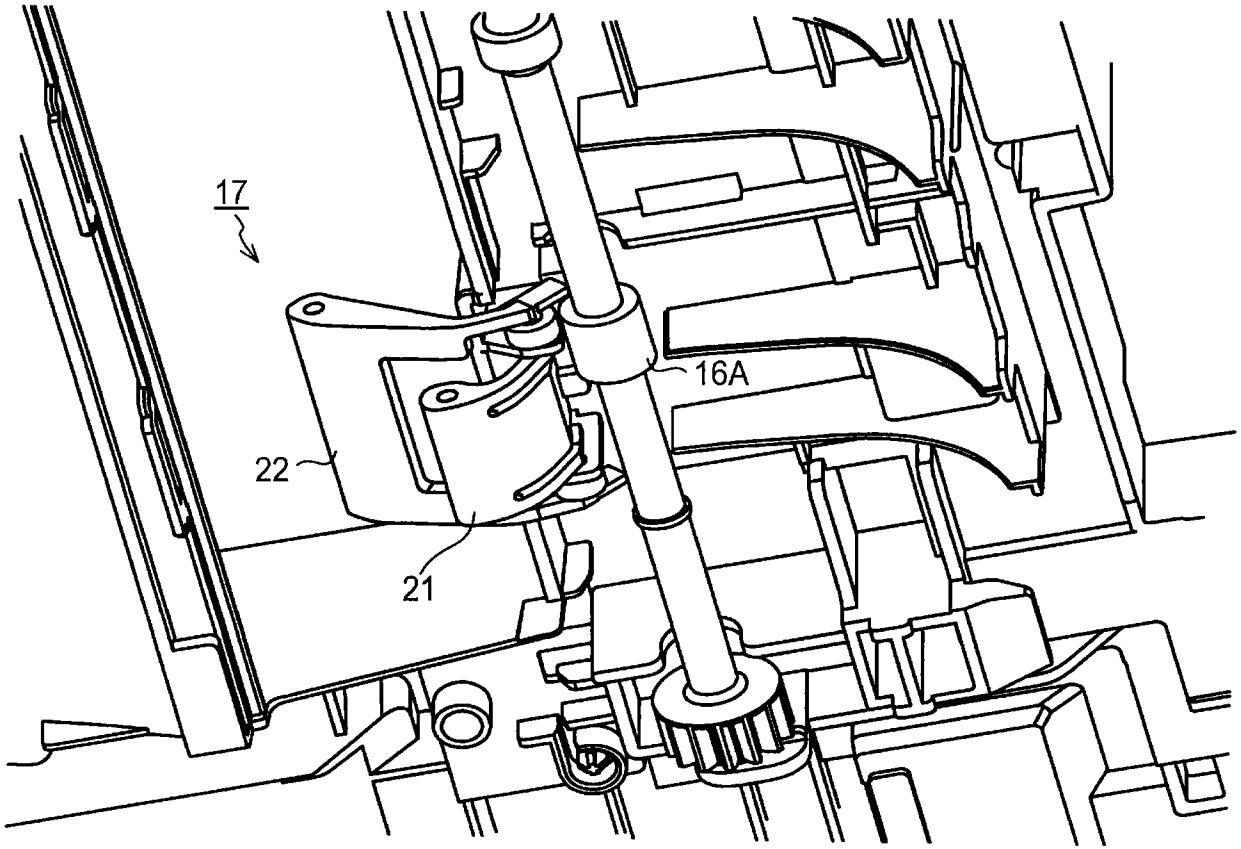
FIG. 4 is a perspective view showing a first pressing member and a second pressing member in the first embodiment obliquely from below.
Figure 4:
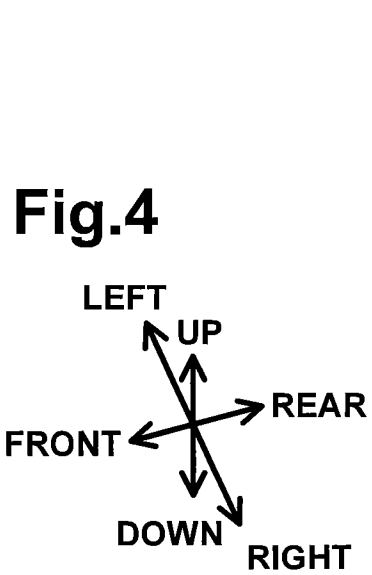
Figure 5:
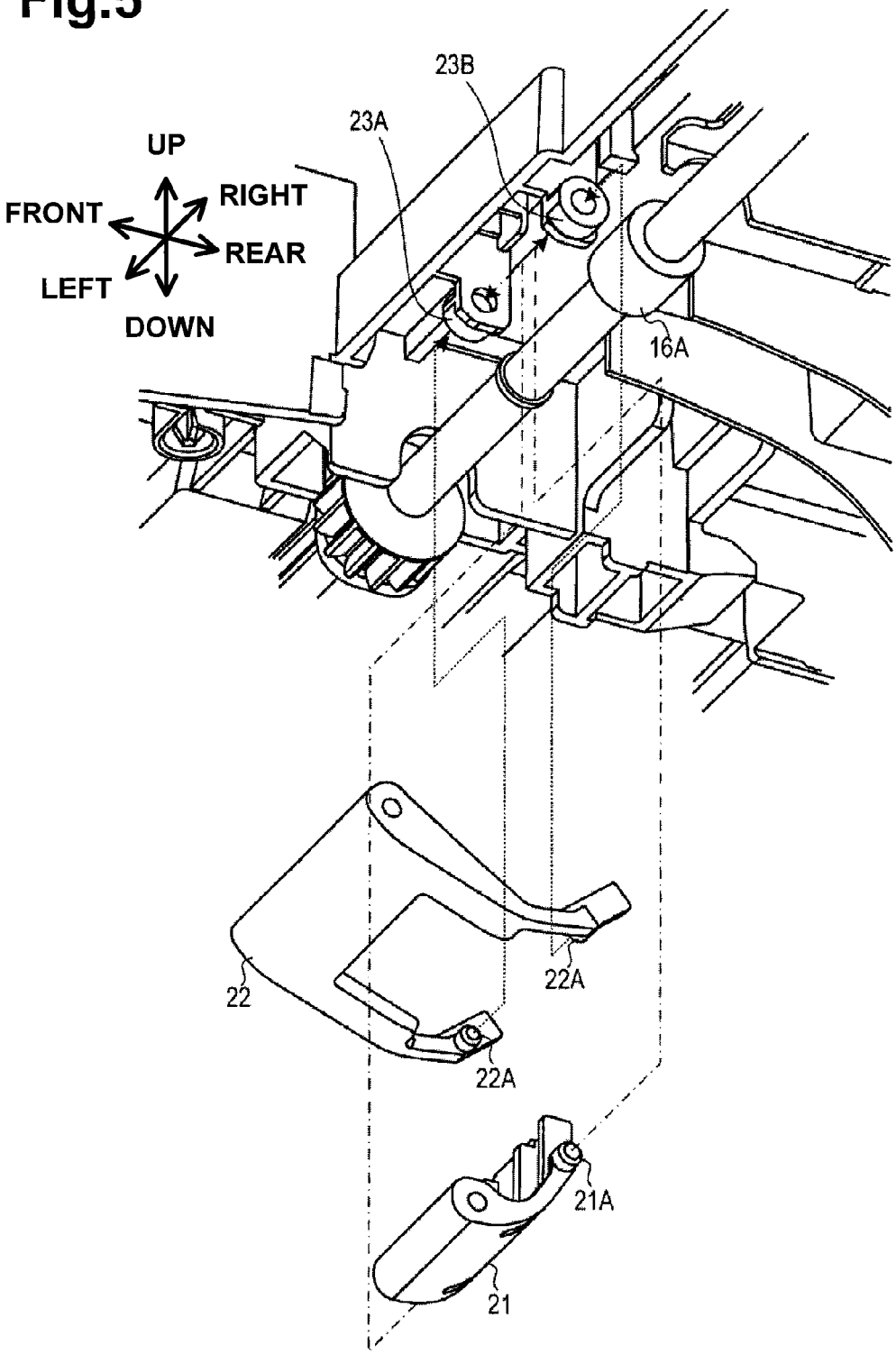
FIG. 5 is an exploded perspective view showing the first pressing member and the second pressing member in the first embodiment obliquely from below.

Further, the first pressing member 21 and the second pressing member 22 are configured to pivot or rotate about a common pivot or rotating axis as shown in FIGS. 4 and 5. Specifically, bearings 23A and 23B are provided on a body side of the multi function device 1, and pivot shafts 21A of the first pressing member 21 are fitted between the bearings 23A and 23B. In addition, pivot shafts 22A of the second pressing member 22 are fitted so as to sandwich the bearings 23A and 23B from the outside. Bearings 23A and 23B are structured to pivotably or rotatably support the shafts 21A of the first pressing member 21 and the shafts 22A of the second pressing member 22 on a common axial line.

Further, the first pressing member 21 and the second pressing member 22 are configured such that when either or both pivot or rotate, the first pressing member 21 can enter an opening of the second pressing member 22. In one or more examples, the opening may be an internal opening that is partially or entirely surrounded by the second pressing member 22.

For example, the second pressing member 22 is formed of a left end portion, a front end portion, and a right end portion forming, from a planar view, a substantially U-shape. Accordingly, the U-shape may include an opening. Meanwhile, the first pressing member 21 is formed to have a shape and size configured to enter the opening formed by the U-shaped portion of the second pressing member 22. Thus, the first pressing member 21 and the second pressing member 22 can move (e.g., pivot or rotate) to positions overlapping each other in the width-wise direction of the sheet.

Figure 6:
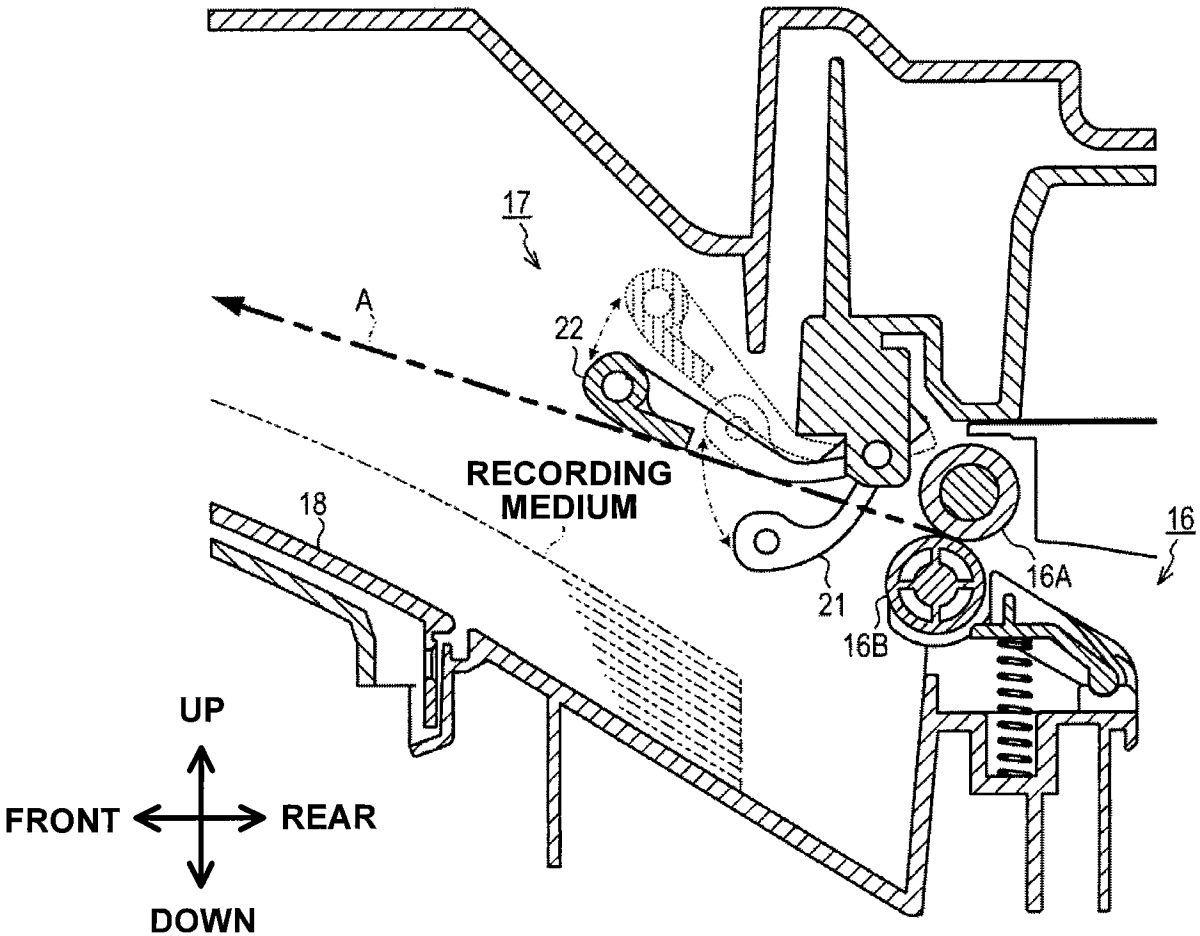
FIG. 6 is a longitudinal cross-sectional view illustrating example movement of the first pressing member and the second pressing member in the first embodiment.

Further, the first pressing member 21 and the second pressing member 22 are configured such that, as shown in FIG. 6, when a sheet is discharged, the second pressing member 22 comes into contact with the sheet on a downstream side of the first pressing member 21 in the discharge direction. In addition, the distance from the pivot or rotation center of the second pressing member 22 to the portion of the second pressing member 22 configured to contact the sheet is longer than that of the first pressing member 21. Moreover, when the first pressing member 21 and the second pressing member 22 are shifted to initial positions (positions indicated by solid lines in FIG. 6) corresponding to positions when no sheet is discharged, the portion of the first pressing member 21 configured to contact the sheet is located lower (e.g., in the indicated up-down direction) than the portion of the second pressing member 22 configured to contact the sheet.

In one example, in the multi function device 1, a discharge roller 16A and a pinch roller 16B are provided near an end of a transfer path of the discharging mechanism 16. In the case of a standard sheet (e.g., a predefined standard size, weight, thickness, etc.), the sheet is sent out by the discharge roller 16A and the pinch roller 16B, in a direction along a surface represented by an arrow A in FIG. 6 (hereinafter, also referred to as a reference surface).

The initial position of the first pressing member 21 is located/oriented lower than the reference surface, and the initial position of the second pressing member 22 is located/oriented so as to be in contact with the reference surface. For example, the first pressing member 21 is located lower than the second pressing member 22.

If the first pressing member 21 and the second pressing member 22 are arranged according to the positional relationship described above, when a sheet is discharged in the direction indicated by arrow A (FIG. 6) along the reference surface without curling, the sheet is pressed downwardly by the first pressing member 21. For example, when the sheet is discharged in the direction along the reference surface without curling, the second pressing member 22 contacts the sheet without substantially pressing the sheet.

On the other hand, when a sheet curls and a portion thereof is cambered upwardly beyond the reference surface, the cambered portion is pressed by the second pressing member 22. Thus, even when a pressing force which is great enough to suppress curling cannot be applied by or from the first pressing member 21, a pressing force from the second pressing member 22 is added, and thus, suppression of curling may be improved or enhanced.

In some arrangements, the pressing force applied from the first pressing member 21 to the sheet may be small. Due to the small pressing force of the first pressing member 21, even when a limp sheet contacts the first pressing member 21, the first pressing member 21 can be prevented from buckling such a sheet.

Further, in some examples, the second pressing member 22 presses a sheet only when a portion of the sheet is cambered upwardly beyond the reference surface. In this case, a slightly larger pressing force (e.g., resulting from pressing forces from both first pressing member 21 and second pressing member 22) may be applied. Accordingly, when the second pressing member 22 and the first pressing member 21 are provided as separate members, the pressing force of the second pressing member 22 can be set and/or optimized without affecting (e.g., potentially impairing) the function required for the first pressing member 21. In addition, in a situation where a pressing force is applied from the second pressing member 22 to a sheet, a pressing force is also applied from the first pressing member 21 to the sheet. Thus, this pressing force is favorably applied for applying a larger pressing force.

As described above, according to the multi function device 1, each first pressing member 21 and each second pressing member 22 are provided as the pressing mechanism 17. Thus, different roles can be provided to the first pressing member 21 and the second pressing member 22 depending on the portions which contact a sheet. Moreover, the rotation/pivot range and pressing force of each pressing member 21 and 22 can also be individually defined and/or optimized depending on the role of each pressing member.

In one example, the first pressing member 21 is configured to act as a member which immediately and downwardly shifts the rear end of a sheet. Using a first pressing member 21 so configured, the front edge of a sheet that is subsequently discharged can be prevented from colliding against the rear edge of a previously discharged sheet.

Further, each second pressing member 22 is configured to act as a member which suppresses curling of a sheet. In such a configuration, the front edge of a sheet that is subsequently discharged can be prevented from colliding against the rear edge of a curled sheet.

Further, the first pressing member 21 and the second pressing member 22 serve to press, from above, a sheet that has been discharged to the discharge portion. In the case of the multi function device 1 in FIGS. 1 and 2, the scanner section 3 is located above the discharge tray 18, and thus a sheet is discharged to a confined or limited space. Even in such a case, the first pressing member 21 and the second pressing member 22 press discharge recording media so that a sufficient number of recording media can be loaded.

Moreover, the first pressing member 21 and the second pressing member 22 are configured such that the first pressing member 21 can enter the opening of the second pressing member 22. As such, a structure is provided in which the first pressing member 21 and the second pressing member 22 are arranged in positions which at least partially overlap each other in the width-wise direction of the sheet.

Therefore, when the first pressing member 21 and the second pressing member 22 are arranged side by side in the width-wise direction of the sheet, the range occupied by the rotation of the first pressing member 21 and the second pressing member 22 may be reduced. In addition, since the first pressing member 21 and the second pressing member 22 rotate or pivot to the positions which overlap each other when seen from the width-wise direction of the sheet, the rotation or movement ranges of the pressing members 21 and 22 can more freely be set as compared to the case where a structure is provided in which the pressing members cannot rotate or move to positions which overlap each other in the width-wise direction. Further, since spaces required for rotation or movement of the pressing members 21 and 22 overlap each other, such spaces can be reduced in size as compared to the case where such spaces do not overlap each other.

Further, in the multi function device 1, the first pressing member 21 and the second pressing member 22 are configured to rotate or pivot about a common axis. Thus, as compared to the case where the pressing members rotate or pivot about different axes, respectively, spaces required for placement of the multiple different pivot shafts can be reduced. Due to this, the multi function device 1 can be reduced in size.

Additionally, both edges of the sheet in the width direction thereof are pressed by the two pressing mechanisms 17. Thus, as compared to the case where similar positions are pressed by a single pressing mechanism, each pressing mechanism 17 can be reduced in size. Due to this, the multi function device 1 can be reduced in size.

Second Example Embodiment

The general structure of an image forming apparatus according to a second embodiment may be similar to that of the image forming apparatus according to the first embodiment described above. Thus, description of similar features may be omitted.

Figure 7:
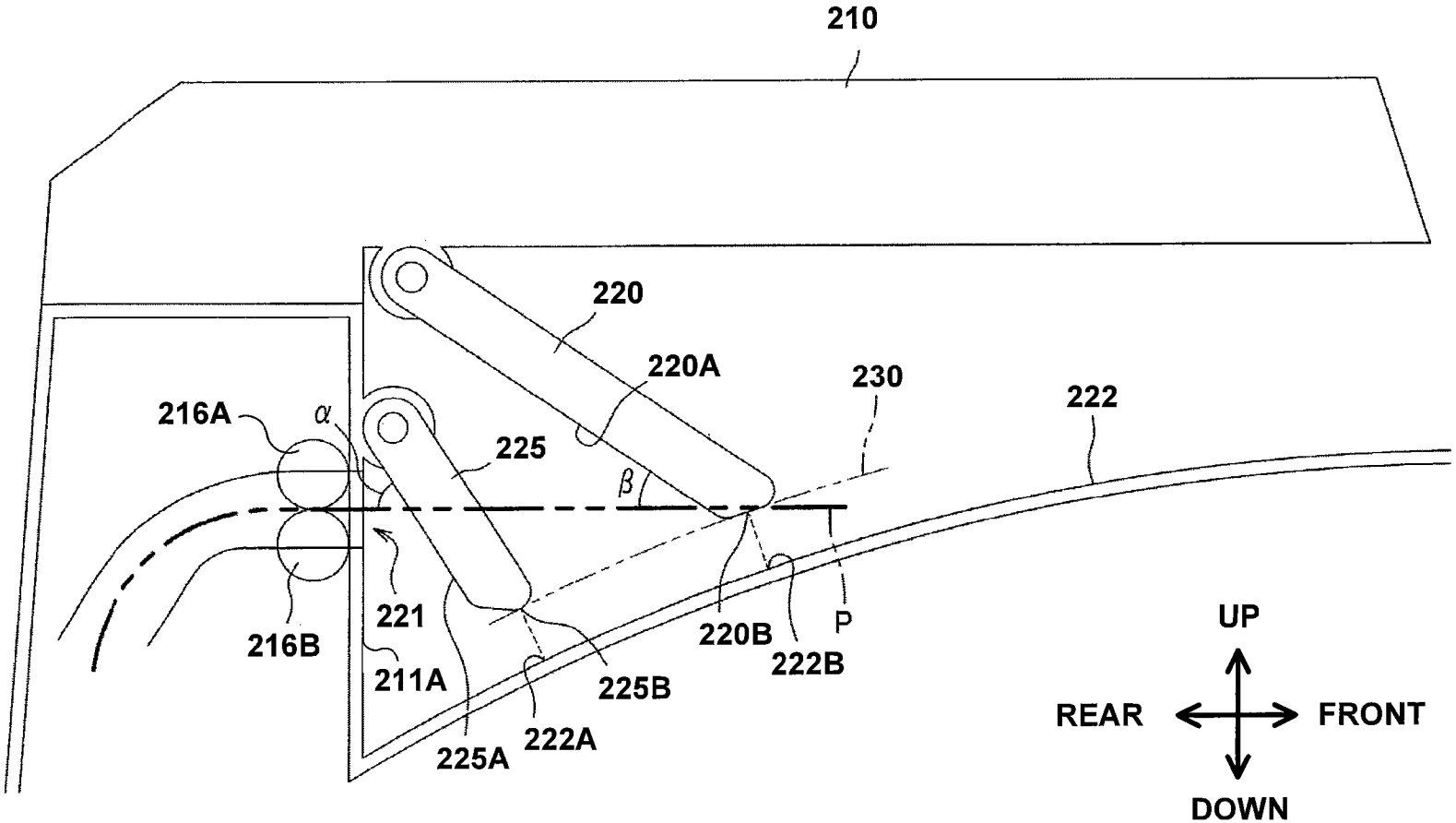
FIG. 7 is a longitudinal cross-sectional view illustrating an example first pressing member and a second pressing member in a second embodiment.

As shown in FIG. 7, near an outlet 221 through which a sheet P is discharged by a discharge roller 216A and a pinch roller 216B, first pressing members 225 and second pressing members 220 are provided and configured to press rear portions of both edges in the width-wise direction (hereinafter, referred to as both edges) of the sheet P discharged from the outlet 221.

The first pressing members 225 are located at positions spaced apart from each other in the width-wise direction of the sheet (see FIG. 9), and is supported at a base portion by a first wall 211A so as to be able to pivot or rotate. The first pressing members 225 may further extend from a position above the outlet 221 (a position distant from a discharge tray 222) forward and obliquely downward (toward the discharge tray 222) such that the lower end of the first pressing members 225 is located lower than the outlet 221. In a particular example, the first pressing member 225 extends to a position lower than the sheet P when sheet P is discharged from the outlet 221. The first pressing member 225 is formed to be lightweight such that when the front edge of the sheet P transferred from the outlet 221 comes into contact with the first pressing member 225, the first pressing member 225 more easily retracts forward.

Further, downward rotation or pivoting of the first pressing member 225 is restricted by a stopper (not shown) such that the angle between a contact surface 225A configured to contact the front edge of the discharged sheet P and the upper surface of the sheet P whose front edge comes into contact with the contact surface 225A is a predetermined angle $\alpha$ (e.g., an acute angle).

Each second pressing member 220 is formed to be larger than each first pressing member 225 in order to render a downward rotation moment of the second pressing member 220 greater than that of the first pressing member 225. Each second pressing member 220 is located at a position which overlaps a corresponding one of the first pressing members 225 from the perspective of the transfer direction of the sheet (see FIG. 9). The second pressing member 220 is supported at a base portion thereof by a lower surface of a flat-bed scanner 210 so as to be able to rotate or pivot, and extends from a position above the first pressing member 225 (a position distant from the discharge tray 222) forward and obliquely downward (toward the discharge tray 22).

Further, downward rotation or pivoting of the second pressing member 220 is restricted by a stopper (not shown) such that the angle between a contact surface 220A configured to contact the front edge of a discharged sheet P and the upper surface of the sheet P whose front edge comes into contact with the contact surface 220A is an angle $\beta$ smaller than the angle $\alpha$.

A free end of the second pressing member 220 is located on the downstream side of a free end of the first pressing member 225 in the transfer direction of the sheet. In addition, the second pressing member 220 is located such that when the sheet P is not in contact with the second pressing member 220 (e.g., the state illustrated in FIG. 7), the distance from the first wall 211A to the front end 220B of the second pressing member 220 closest to the discharge tray 222 is equal to or less than half of a longitudinal length of a sheet P having an A4 size (e.g., a longest size that might be used in the color multi function device 1). For example, the distance from the first wall 211A configured to restrict the rear edges of the recording media P on the discharge tray 222 to the front end 220B of the second pressing member 220 along the shape of the discharge tray 222 is equal to or less than half of the longitudinal length of the sheet P having an A4 size. Thus, the rear portions of the recording media P on the discharge tray 222 can be pressed by the first pressing member 225 and the second pressing member 220.

Further, the front end 225B of the first pressing member 225 and the front end 220B of the second pressing member 220 are located on a line 230 extending in the same or similar shape as the shape of the discharge tray 222. For example, the front ends 225B and 220B may follow a contour or shape of the discharge tray 222. In a particular example, the line 230 may mimic the shape or contour of the discharge tray 222 or a surface thereof. Thus, the first pressing member 225 and the second pressing member 220 can press the recording media P loaded on the discharge tray 222, so as to correspond to the shape of the recording media P. Additionally or alternatively, the inclination of a surface 222B of the discharge tray 222 facing the front end 220B of the second pressing member 220 may be closer to the horizontal direction than the inclination of a surface 222A of the discharge tray 222 facing the end 225B of the first pressing member 225.

Figure 9:
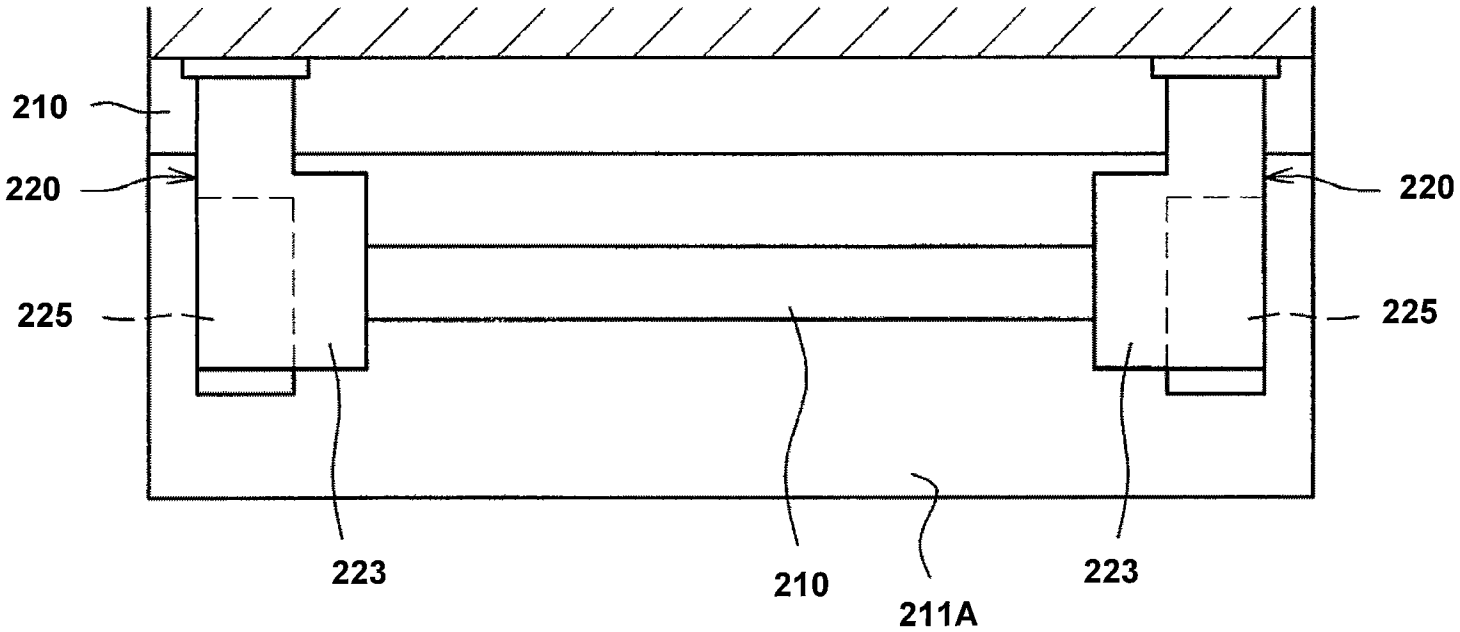
FIG. 9 is a view showing the first pressing member and the second pressing member in the second embodiment from above.

As shown in FIG. 9, a projection 223 is formed in each second pressing member 220 and projects inwardly of each first pressing member 225 in the width-wise direction of the sheet. Thus, even when the width of the sheet P is small and the rear portions of both edges of the sheet P cannot be pressed by the first pressing member 225, the rear portions of both edges of the sheet P can be pressed by the second pressing member 220.

Figure 8:
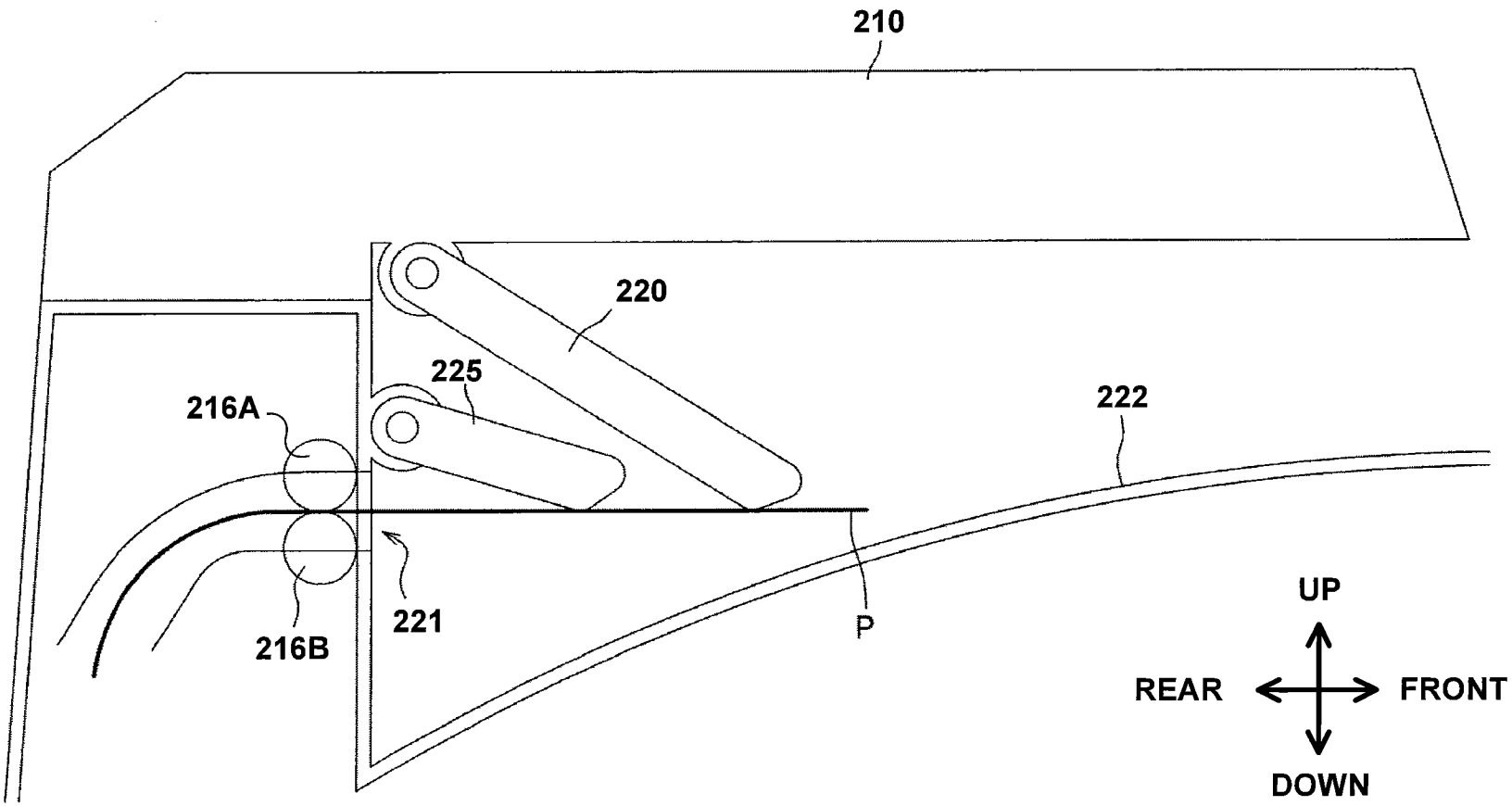
FIG. 8 is a longitudinal cross-sectional view illustrating example movement of the first pressing member and the second pressing member in the second embodiment.

As described above, according to the multi function device 1, when the sheet P is discharged from the outlet 221 as shown in FIG. 8, each first pressing member 225 and each second pressing member 220 are pressed by the front edge of the sheet P, whereby the first pressing member 225 and the second pressing member 220 rotate or pivot forward so as to move away from the outlet 221. In comparison to a case in which a range as large as a range pressed by the first pressing member 225 and the second pressing member 220 is pressed by a single large pressing member, the first pressing member 225 and the second pressing member 220 can be formed to be smaller in size, and may thus more easily rotate or pivot when the sheet P discharged from the outlet 221 comes into contact therewith, and the sheet P may be smoothly discharged.

Figure 10:
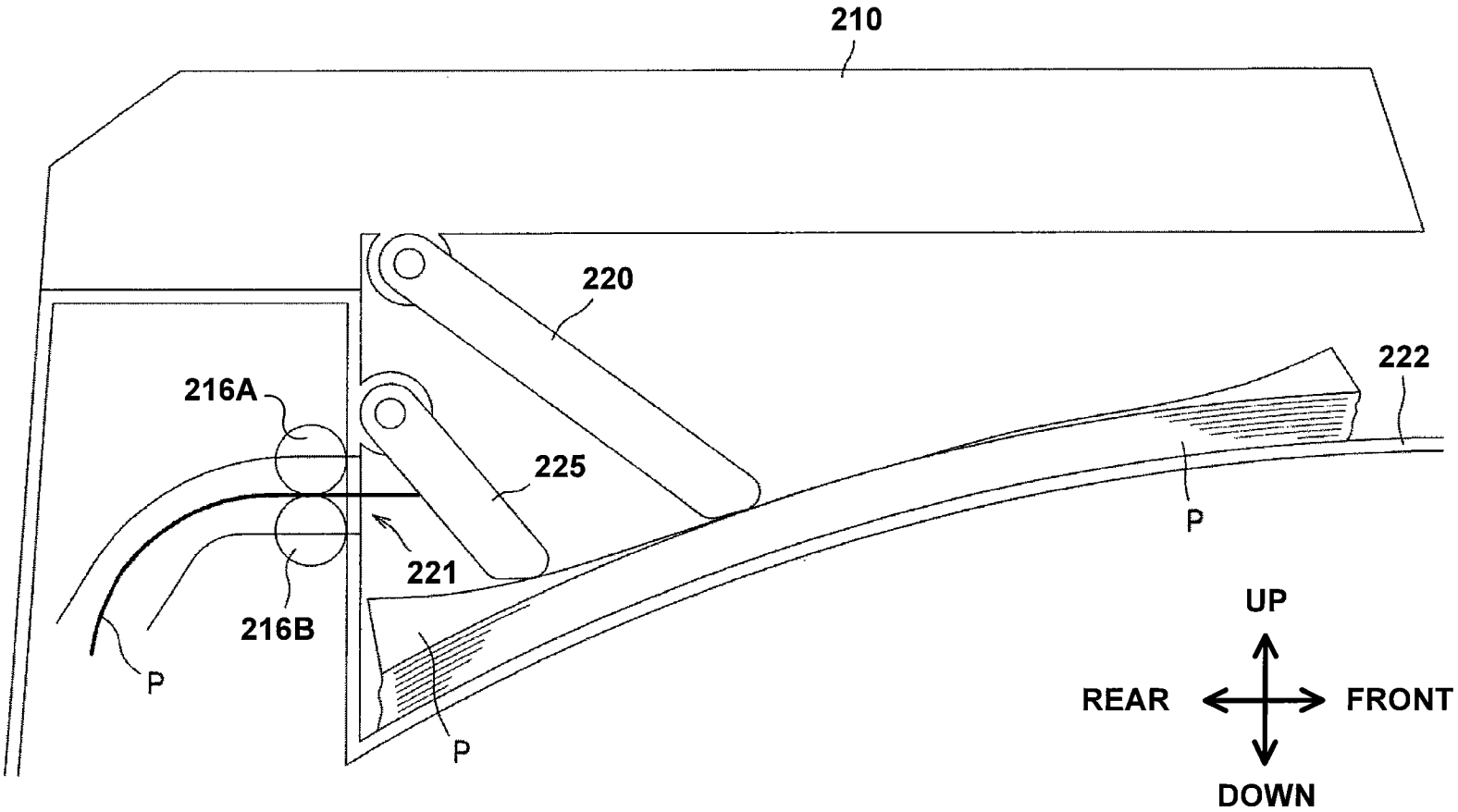
FIG. 10 is a diagram illustrating an example state in which the first pressing member and the second pressing member in the second embodiment presses the rear edge portions of recording media on a discharge tray.

When the sheet P is loaded on the discharge tray 222 and moves away from the first pressing member 225 and the second pressing member 220, the first pressing member 225 and the second pressing member 220 rotate or pivot downward due to their respective weights. At that time, as shown in FIG. 10, when a plurality of recording media P are loaded on the discharge tray 222, the first pressing members 225 and the second pressing members 220 are in contact with the rear portions of both edges of the sheet P. As described above, the rear portion of each of the edges of the discharged sheet P is pressed at two positions in the transfer direction of the sheet by the first pressing member 225 and the second pressing member 220. Thus, even when the sheet P has curled to have a cylindrical curl, its rear portion can be pressed downward of the outlet 221 (the sheet P being discharged from the outlet 221). As a result, a sheet P subsequently transferred from the outlet 221 may be prevented from contacting the cylindrical curl and becoming jammed. Moreover, the above described configuration may prevent a sheet P loaded on the discharge tray 222 from being pushed forward.

Since the front end 225B of the first pressing member 225 and the front end 220B of the second pressing member 220 are located on the line 230 extending in the same or similar shape as the shape of the facing discharge tray 222, the sheet P can be pressed so as to correspond to the shape of the recording media P loaded along the shape of the discharge tray 222.

Further, since the downward rotation moment of the second pressing member 220 is greater than that of the first pressing member 225, the discharged sheet P can be reliably pressed. In addition, due to the larger downward rotation moment, even when the second pressing member 220 is not caused to rotate or pivot by the front edge of the sheet P, a front edge of the sheet P is directed toward the discharge tray 222 by contact with the second pressing member 220. The sheet P is further discharged forward along the discharge tray 222, since the inclination of the surface 222B of the discharge tray 222 which faces the second pressing member 220 is nearly horizontal. Meanwhile, since the downward rotation moment of the first pressing member 225 is smaller than that of the second pressing member 220, the first pressing member 225 may reliably rotate or pivot when the front edge of the sheet P comes into contact with the first pressing member 225.

Further, since the angle $\beta$ between the contact surface 220A of the second pressing member 220 and the upper surface of the sheet P whose front edge comes into contact with the second pressing member 220 is smaller than the angle $\alpha$, even when the second pressing member 220 is not pressed by the front edge of the sheet P and thus, not caused to rotate or pivot, the sheet P is discharged forward along the contact surface of the second pressing member 220 without curling up, due to the downward rotation moment of the second pressing member 220.

Since the second pressing member 220 projects inwardly of the first pressing member 225 in the width-wise direction of the sheet, even when the recording media P is small in size, each of the rear positions of both edges of the small-size sheet P can be reliably pressed by the second pressing member 220.

In one or more arrangements, the second pressing member 220 may include, at the free end thereof, the projection 223 projecting inwardly in the width-wise direction of the sheet. However, in some examples, the second pressing member 220 may be formed to have a constant width from the base portion to the free end such that the second pressing member 220 is wider than the first pressing member 225 in the width-wise direction of the sheet.

Further, while aspects described herein relate to the second pressing member 220 projecting inwardly of the first pressing member 225 in the width-wise direction of the sheet, in one or more other arrangements, the second pressing member 220 might not project from the first pressing member 225 in the width-wise direction of the sheet.

Additionally, while aspects described herein relate to the second pressing member 220 being formed to be larger than the first pressing member 225 such that the downward rotation moment of the second pressing member 220 is greater than that of the first pressing member 225, in one or more other arrangements, the second pressing member 220 may be formed from a material having a density higher than that of the first pressing member 225.

Still further, while aspects described herein relate to the first pressing member 225 being supported by the first wall 211A of the apparatus housing and the second pressing member 220 being supported by the flat-bed scanner 10, in some examples, the first pressing member 225 and the second pressing member 220 may be supported by either the first wall 211A or by the flat-bed scanner 10.

Further, one or more aspects of the embodiments described above relate to an image forming apparatus configured to form an image by electrophotography. However, other recording methods (e.g., inkjet method, thermal transfer method etc.) may be used. Additionally, the configurations described herein may also be used in a multi function apparatus having functions other than an image forming function (e.g., an image reading function, a communication function etc.).

What is claimed is:

1. An image-forming apparatus comprising:

an image-forming unit configured to form an image on a sheet;

a discharging unit configured to discharge the sheet onto a discharge tray;

a sheet-pressing unit configured to pivot about a common axis, wherein the common axis is provided at a first position above a second position where the discharging unit and the sheet come into contact with each other, wherein the sheet-pressing unit includes a first pressing member and a second pressing member, each of the first pressing member and the second pressing member configured to independently pivot about the common axis and downwardly press the sheet by contacting the sheet, wherein the first pressing member and the second pressing member are configured to contact the sheet at different positions along the discharge direction, and wherein the first pressing member and the second pressing member are configured such that when one or more of the first and second pressing members pivot, the first pressing member is configured to enter a space of the second pressing member, whereby the first and second pressing members are movable to overlap each other in the width-wise direction of the sheet.

2. The image-forming apparatus according to claim 1, wherein the second pressing member is configured to contact the sheet on a downstream side of the first pressing member in the discharge direction when the sheet is discharged from the discharging unit, wherein the first pressing member and the second pressing member are configured such that a distance between the common axis and a portion of the second pressing member configured to contact the sheet is greater than a distance between the common axis and a portion of the first pressing member configured to contact the sheet, and wherein the portion of the first pressing member configured to contact the sheet is located below the portion of the second pressing member configured to contact the sheet when the first and second pressing members are in initial positions when the sheet is not discharged from the discharging unit.

3. The image-forming apparatus according to claim 1, wherein the first pressing member and the second pressing member are provided at overlapping positions in the discharge direction.

4. The image-forming apparatus according to claim 1, wherein the first pressing member and the second pressing member are provided at overlapping positions in a width-wise direction of the sheet when discharged.

5. The image-forming apparatus according to claim 1, wherein when the first and second pressing members are in initial positions when the sheet is not discharged from the discharging unit, a portion of the first pressing member closest to the discharge tray and a portion of the second pressing member closest to the discharge tray are positioned along a shape of the discharge tray.

6. The image-forming apparatus according to claim 1, wherein a portion of the second pressing member comprises a projection that extends inwardly of the first pressing member in the width-wise direction of the sheet.

7. The image-forming apparatus according to claim 1, wherein the second pressing member is configured to have an opening including the space, wherein the space is bounded in the width-wise direction by the second pressing member.

8. The image-forming apparatus according to claim 1, wherein the pressing unit is further configured to press both edges of the sheet in the width-wise direction of the sheet by being located at a plurality of spaced-apart positions in the width-wise direction of the sheet.

9. A sheet-discharging device comprising:

a discharging unit configured to discharge a sheet onto a discharge tray; and a sheet-pressing unit configured to pivot about a common axis, wherein the common axis is provided at a first position above a second position where the discharging unit and the sheet come into contact with each other, wherein the sheet-pressing unit includes a first pressing member and a second pressing member, each of the first pressing member and the second pressing member configured to independently pivot about the common axis and downwardly press the sheet by contacting the sheet, wherein the first pressing member and the second pressing member are configured to contact the sheet at different positions along the discharge direction, and wherein the first pressing member and the second pressing member are configured such that when one or more of the first and second pressing members pivot, the first pressing member is configured to enter a space of the second pressing member, whereby the first and second pressing members are movable to overlap each other in the width-wise direction of the sheet.

* * * * *